US009349515B2

(12) United States Patent
Kondo

(10) Patent No.: US 9,349,515 B2
(45) Date of Patent: May 24, 2016

(54) LINEAR SOLENOID

(71) Applicant: DENSO CORPORATION, Kariya, Aichi-pref. (JP)

(72) Inventor: Jiro Kondo, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/486,537

(22) Filed: Sep. 15, 2014

(65) Prior Publication Data

US 2015/0077204 A1 Mar. 19, 2015

(30) Foreign Application Priority Data

Sep. 19, 2013 (JP) ..... 2013-193689
Sep. 19, 2013 (JP) ..... 2013-193691
Jan. 23, 2014 (JP) ..... 2014-10061

(51) Int. Cl.
*H01F 7/16* (2006.01)
*H01F 7/08* (2006.01)

(52) U.S. Cl.
CPC ..... *H01F 7/1607* (2013.01); *H01F 2007/086* (2013.01)

(58) Field of Classification Search
CPC ..... H01F 7/1607; H01F 2007/086
See application file for complete search history.

(56) References Cited

U.S. PATENT DOCUMENTS

2002/0104977 A1* 8/2002 Bircann et al. ..... 251/129.15
2004/0257185 A1 12/2004 Telep
2009/0039992 A1 2/2009 Ryuen et al.
2009/0200502 A1* 8/2009 Hoppe et al. ..... 251/129.15
2011/0248805 A1* 10/2011 Hamaoka et al. ..... 335/278
2012/0199086 A1 8/2012 Hori et al.
2012/0242436 A1 9/2012 Murao

FOREIGN PATENT DOCUMENTS

GB 768618 A * 2/1957
JP 2-76280 6/1990
JP 2004-153077 5/2004
JP 2005-299919 10/2005
JP 2009-147075 7/2009

OTHER PUBLICATIONS

Office Action (3 pages) dated Jul. 14, 2015, issued in corresponding Japanese Application No. 2013-193691 and English translation (3 pages).
Kondo, U.S. Appl. No. 14/486,247, filed Sep. 15, 2014.
Office Action (2 pages) dated Jul. 14, 2015, issued in corresponding Japanese Application No. 2013-193686 and English translation (2 pages).
Office Action (2 pages) dated Sep. 8, 2015, issued in corresponding Japanese Application No. 2014-010061 and English translantion (2 pages).

* cited by examiner

*Primary Examiner* — Mohamad Musleh
(74) *Attorney, Agent, or Firm* — Nixon & Vanderhye PC

(57) ABSTRACT

A linear solenoid includes a movable element, a first stator element, a second stator element, a third stator element, a cover and a through hole. The third stator element has an opening formed on a thrust direction side of the third stator element. The cover covers the opening of the third stator element from the thrust direction side of an axial direction. The through hole passes through the third stator element. An inside of the third stator element is in fluid communication with an outside of the third stator element through the through hole.

12 Claims, 8 Drawing Sheets

LINEAR SOLENOID

CROSS REFERENCE TO RELATED APPLICATION

This application is based on and incorporates herein by reference Japanese Patent Application No. 2013-193689 filed on Sep. 19, 2013, Japanese Patent Application No. 2013-193691 filed on Sep. 19, 2013 and Japanese Patent Application No. 2014-10061 filed on Jan. 23, 2014.

TECHNICAL FIELD

The present disclosure relates to a linear solenoid that outputs a thrust force in an axial direction.

BACKGROUND

A linear solenoid that outputs a thrust force when magnetic flux is generated by energizing a coil has been conventionally known. Such a linear solenoid is installed in a vehicle, for example.

In order to expand a movement amount (hereinafter referred as a "stroke") of a movable element in an axial direction without an increase in the size of the linear solenoid in the axial direction, a linear solenoid having a cylindrical portion, the movable element and a plurality of stators that are respectively disposed outside and inside of the cylindrical portion has been presented.

For example, a patent document (JP 2005-045217 A) discloses a linear solenoid including a magnetic movable element and a first to third stators.

The movable element includes a cylindrical magnetic portion and is coaxially housed inside a coil and movable in an axial direction of the coil. The first stator is disposed inside of the cylindrical magnetic portion of the movable element and allows the magnetic flux to flow toward the movable element in a radial direction (i.e., provides the magnetic flux to the movable element). The second stator is made of magnetic material and has a cylindrical shape. The second stator is disposed radially outside of the movable element and the movable element is interposed between the first stator and the second stator. The second stator also allows the magnetic flux to flow toward the movable element in the radial direction. Further, the third stator element is positioned away from the second stator element in the axial direction and attracts the movable element in the axial direction.

In a use of a linear solenoid, oil or water, etc. may be introduced into and discharged from the linear solenoid according to movement of a movable element. In such a use of the linear solenoid, oil or water, etc. needs to be smoothly introduced into and discharged from the linear solenoid in order to reduce energy loss due to the movement of the movable element. However, since the linear solenoid in the patent document has no configuration for the smooth introduction and discharge of oil or water, etc., the responsiveness of the movable element may be significantly deteriorated.

Furthermore, in the linear solenoid of the patent document, the cylindrical magnetic portion of the movable element has substantially the same length in the axial direction as that of the first stator element. Thus, when the stroke of the movable element is increased, areas of the movable element and the first stator element, which contribute (i.e., involve) to provide magnetic flux, are reduced, and thus attraction force may be reduced.

SUMMARY

In view of the above, an object of the present disclosure is to provide a linear solenoid having high responsiveness of a movable element by realizing smooth introduction and discharge of fluid, such as oil or water. Another object of the present disclosure is to provide a linear solenoid, in which reduction of attraction force can be suppressed even when a stroke of a movable element is increased.

In a first aspect of the present disclosure, the linear solenoid outputs the thrust force in the axial direction toward the thrust direction side of the axial direction and includes the movable element, the first stator element, the second stator element, the third stator element and the through hole.

The movable element has a cylindrical magnetic portion. The movable element is coaxially disposed inside of the coil and movable in the axial direction. The first stator element is disposed inside of the cylindrical magnetic portion of the movable element and provides magnetic flux to the movable element in the radial direction. The first stator element is made of magnetic material.

The second stator element has a cylindrical shape and made of magnetic material. The second stator element is disposed outside of the movable element in the radial direction that is interposed between the first stator element and the second stator element, and provides magnetic flux to the movable element in the radial direction. The third stator element has a cylindrical shape and made of magnetic material. The third stator element is disposed on a thrust direction side of the second stator element, magnetically attracts the movable element toward the thrust direction side of the axial direction to draw the movable element into an inside of the third stator element, and has an opening formed on the thrust direction side of the third stator element. The cover covers the opening of the third stator element. The through hole extends through the third stator element. The through hole provides fluid communication between the inside of the third stator element and an outside of the third stator element.

According to the first aspect of the present disclosure, fluid can be introduced into and discharged from the linear solenoid through the through hole. As a result, fluid can be smoothly introduced into and discharged from the linear solenoid, whereby improving responsiveness of the movable element.

In a second aspect of the present disclosure, the linear solenoid outputs a thrust force in the axial direction toward the thrust direction side of the axial direction when magnetic flux is generated by energizing the coil. The linear solenoid includes the movable element, the first stator element, the second stator element, and the third stator element.

The movable element has a cylindrical magnetic portion. The movable element is coaxially disposed inside of the coil and movable in the axial direction. The first stator element is disposed inside of the cylindrical magnetic portion of the movable element and provides magnetic flux to the movable body in the radial direction. The first stator element is made of magnetic material.

The second stator element has a cylindrical shape and made of magnetic material. The second stator element is disposed outside of the movable element in the radial direction that is interposed between the first stator element and the second stator element, and provides magnetic flux to the movable element in the radial direction. The third stator element has a cylindrical shape and is made of magnetic material. The third stator element is disposed on a thrust direction side of the second stator element, and magnetically attracts the movable element to draw the movable element into the inside of the third stator element. The movable element has a first region on an inner circumferential surface of the movable element that provides magnetic flux between the movable element and the first stator element in the radial direction. The first stator element has a second region on an outer circumferential surface of the first start element that provides magnetic flux between the first stator element and the movable element in the radial direction.

The length of the first region in the axial direction is less than a length of the second region in the axial direction.

Therefore, even when the stroke of the movable element is increased, a decrease in the area that contributes to the provision of the magnetic flux between the movable element and the first stator element can be suppressed. As a result, deterioration of the attraction force can be suppressed even when the stroke of the movable element is increased.

In a third aspect of the present disclosure, the output member is fixed to the thrust direction side of the movable element. The output member is formed of non-magnetic material and moves integrally with the movable element toward the thrust direction side of the axial direction to output the thrust force. The output member is formed of non-magnetic material. The output member has a connecting portion having a cylindrical shape and coaxially fixed to the movable element, a shaft portion that passes through the cover to protrude toward the thrust direction side of the axial direction and that transmits the thrust force to the outside of the third stator element, and a hole portion through which an inside of the connecting portion fluidly communicates with an outside of the connecting portion. The thrust direction side end of the first stator element moves inside the connecting portion in the axial direction relative to the connecting portion.

Accordingly, fluid can be introduced into and discharged from the connecting portion, and thus the movable member (i.e., the movable element and the output member) can further smoothly move in the axial direction.

BRIEF DESCRIPTION OF THE DRAWINGS

The disclosure, together with additional objectives, features and advantages thereof, will be best understood from the following description, the appended claims and the accompanying drawings, in which:

DETAILED DESCRIPTION

Hereinafter, a plurality of embodiments of the present disclosure will be described with reference to the accompanying drawings. In each embodiment, the same reference signs are assigned to corresponding configuration elements, and there is a case where duplicated descriptions are omitted. In each embodiment, when only a part of a configuration of an embodiment is described, a corresponding configuration of another embodiment, which is previously described, is applicable to the other part of the configuration of the embodiment. Insofar as there are no problems with a combination of the configurations, not only can the configurations be combined together as stated in each embodiment, but also the configurations of the plurality of embodiments can be partially combined together even though the partial combinations of the configurations are not stated.

(First Embodiment)

A configuration of a linear solenoid 1 of the first embodiment will be described referring drawings.

The linear solenoid 1 generates magnetic attraction when magnetic flux is generated by energizing a coil 2 and outputs a thrust force toward one side of an axial direction of the linear solenoid 1. The linear solenoid 1 is installed in a vehicle and is used for switching a supply destination of oil pressure in a valve timing mechanism that changes valve timing for an internal combustion engine.

Figure 1:
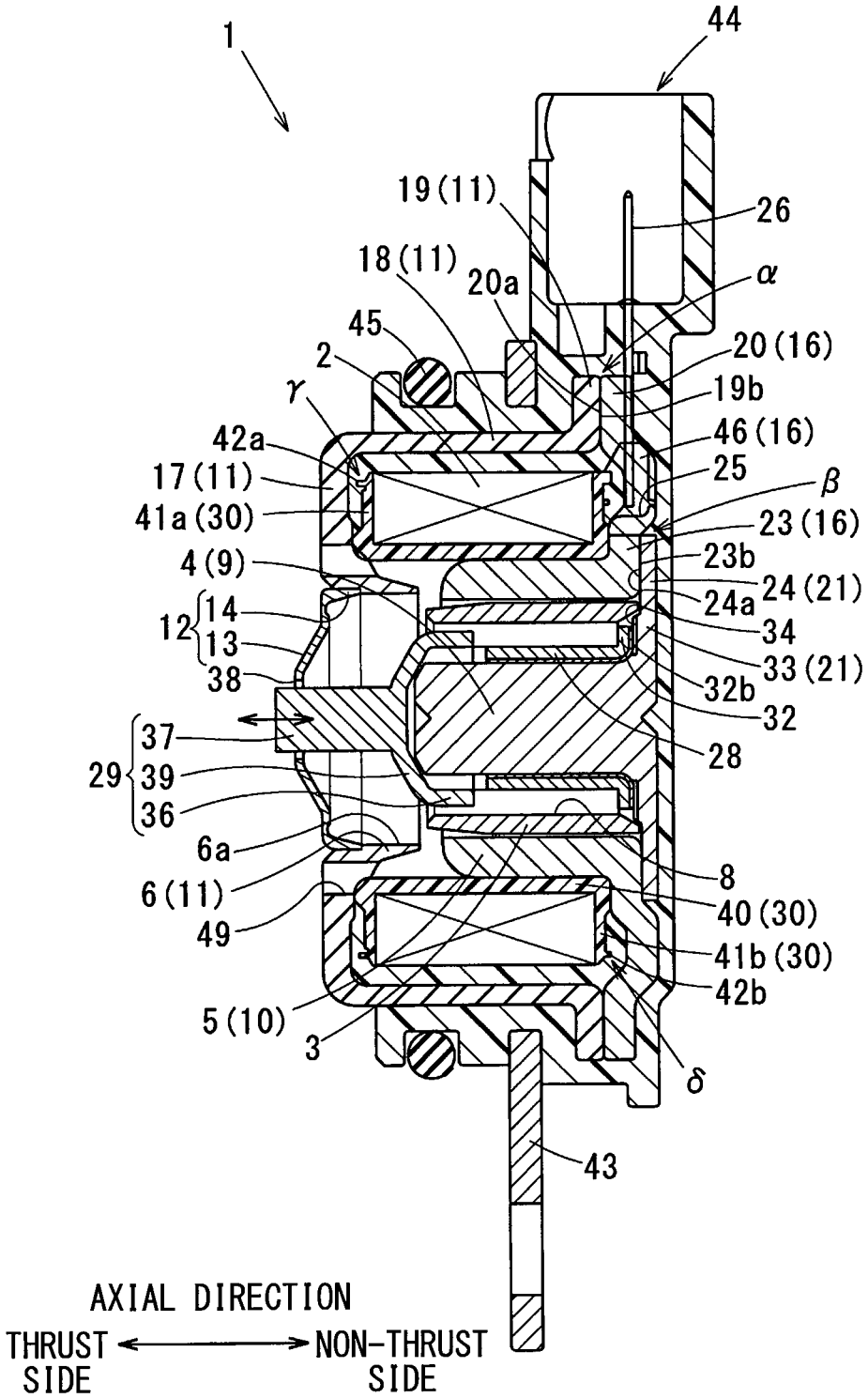
FIG. 1 is a cross-sectional view of a linear solenoid according to a first embodiment.

Hereinafter, the one side of the axial direction, toward which the thrust force is output, is defined as "thrust direction side" of the axial direction and the other side of the axial direction that is opposite to the thrust direction side is defined as "non-thrust direction side" of the axial direction as shown in FIG. 1, etc.

The linear solenoid 1 includes a movable element 3, a first stator 4, a second stator element 5 and a third stator element 6, which involve generation of magnetic attraction.

The movable element 3 has a cylindrical shape and is made of magnetic material. That is, the movable element 3 has a cylindrical magnetic portion. The movable element 3 is slidably housed inside of the coil 2 in an axial direction of the linear solenoid 1. The movable element 3 is coaxially aligned with the coil 2. A breathing passage 8 is formed on the movable element 3 to extend through the movable element 3 between both ends thereof in the axial direction and fluid is introduced into and discharged from the movable element 3 through the breathing passage 8. For example, two breathing passages 8 are formed on an inner wall of the coil 2 at angular intervals of 180 degrees in a circumferential direction of the coil 2 (refer to FIGS. 2A and 2B). Each breathing passage 8 is formed as a groove that passes through the movable element 3 in the axial direction and is open inside the movable element 3.

The first stator 4 is a portion of a first magnetic body 9 that is one of fixed members. The first stator 4 has a cylindrical shape. The first stator 4 is disposed inside of the movable element 3, more specifically, inside of the cylindrical magnetic portion of the movable element 3. The first stator 4 supports slidably the movable element 3 in the axial direction and allows magnetic flux to flow (i.e., to provide magnetic flux) toward the movable element 3 in a radial direction of the linear solenoid 1.

The second stator element 5 is a portion of a second magnetic body 10 that is a separate component from the first magnetic body 9. The second stator element 5 has a cylindrical shape. The second stator element 5 is disposed on an outer circumferential surface of the movable element 3 and provides magnetic flux to the movable element 3 in the radial direction. That is, the movable element 3 is interposed between the first stator 4 and the second stator element 5. A space is defined between an inner circumferential surface of the second stator element 5 and the outer circumferential surface of the movable element 3 so that the movable element 3 moves in the axial direction without being in contact with the second stator element 5.

The third stator element 6 is a portion of a third magnetic body 11 that is a separate component from the first and the second magnetic bodies 9 and 10. The third stator element 6 has a cylindrical shape. The third stator element 6 is coaxially aligned with the second stator element 5 and is disposed away from the second stator element 5 toward the thrust direction side (i.e., the left side in FIG. 1). The third stator element 6 attracts the movable element 3 toward the thrust direction side of the axial direction based on magnetic flux and draws the movable element 3 into an inside of the third stator element 6.

Figure 3:
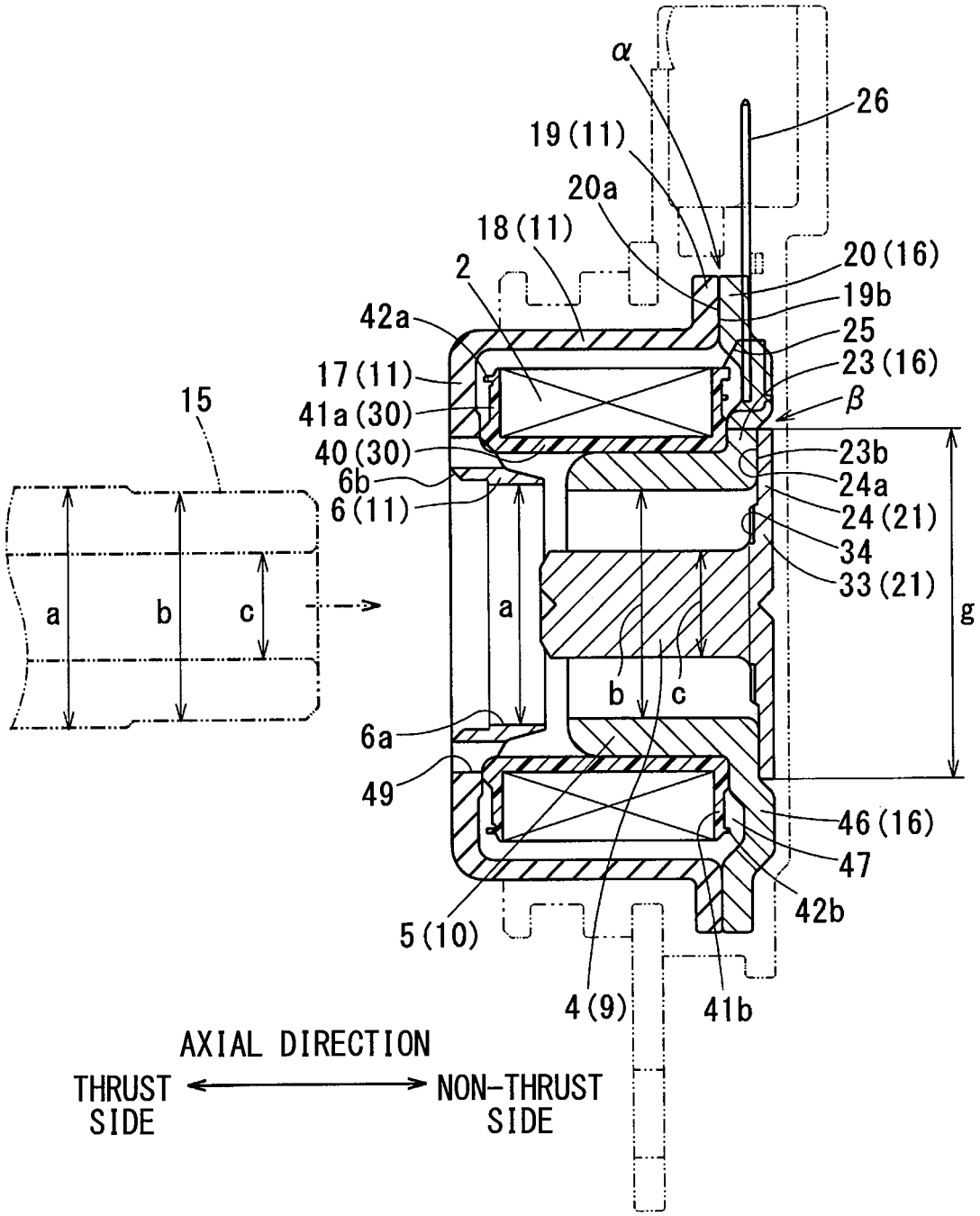
FIG. 3 is a cross-sectional view of a fixed portion of the linear solenoid before molding according to the first embodiment.

As shown in FIG. 3, the third stator element 6 has an opening 6*b* on a thrust direction side of the third stator element 6 (i.e., an opposite side of the third stator element 6 with respect to the second stator element 5 in the axial direction). The opening 6*b* of the third element 6 is covered by a cover 12 that is a different component from the first to the third magnetic bodies 9 to 11. The cover 12 prevents foreign substances from entering into an inside of the linear solenoid 1 from an outside thereof, by, mainly, a covering portion 13 that protrudes toward the thrust direction side of the axial direction. Further, the cover 12 has a cylindrical portion 14 that is press-fitted into the inside of the third stator element 6. Thus, an area that contributes to the provision of magnetic flux is expanded (i.e., enlarged) by the cylindrical portion 14.

In the linear solenoid 1, an inner radius a of the third stator element 6 is greater than an inner radius b of the second stator element 5 (see FIG. 3).

Further, the inner radiuses a and b are greater than an outer radius c of the first stator element 4. Accordingly, a locking tool 15 can be inserted into the opening 6*b* of the third stator element 6 from the thrust direction side of the third stator element 6 in a state where the first to the third stator elements 4 to 6 are set inside of the coil 2. Therefore, the locking tool 15 can directly lock the first to the third stator elements 4, 5 and 6 in the axial direction.

Further, the linear solenoid 1 includes a first providing structure α and a second providing structure β that involve the magnetic flux provision between the first to the third magnetic bodies 9 to 11.

The first providing structure α is a structure to provide magnetic flux by contacting a magnetic body of the second magnetic body 10, which is different from the second stator element 5, with a magnetic body of the third magnetic flux 11, which is different from the third stator element 6.

The second magnetic body 10 has a non-thrust direction side yoke 16 outwardly extending from the non-thrust direction side of the second stator element 5. The non-thrust direction side yoke 16 has an annular plate shape and covers the non-thrust direction side of the coil 2. The third magnetic body 11 has a thrust direction side yoke 17 and a circumferential side yoke 18. The thrust direction side yoke 17 has an annular plate shape. The thrust direction side yoke 17 outwardly extends from the thrust direction side of the third stator element 6 and covers a thrust direction side of the coil 2. The circumferential side yoke 18 has cylindrical shape. The circumferential side yoke 18 extends toward the non-thrust direction side of the axial direction from an outer circumferential edge of the thrust direction side yoke 17 and covers an outer circumferential surface of the coil 2. The third magnetic body 11 has a flange 19 in an annular shape that outwardly extends from a non-thrust direction side of the circumferential side yoke 18.

According to the first providing structure α, magnetic flux is provided when an outer circumferential portion 20 of the non-thrust direction side yoke 16 is in surface contact with the flange 19.

That is, the non-thrust direction side yoke 16 radially extends further outside of the outer circumferential surface of the coil 2 and the outer circumferential portion 20 is positioned radially outward of the outer circumferential surface of the coil 2. A thrust direction side surface 20*a* of the outer circumferential portion 20 is a flat surface perpendicular to the axial direction and a non-thrust direction side surface 19*b* of the flange 19 is also a flat surface perpendicular to the axial direction.

Thus, magnetic flux is provided between the second magnetic body 10 and the third magnetic body 11 at a position outside of the coil 2 when the thrust direction side surface 20*a* contacts on the non-thrust direction side surface 19*b*.

It should be noted that both the flange 19 and the outer circumferential portion 20 have no projection portion and recessed portion for fixing into each other. Therefore, the flange 19 and the outer circumferential portion 20 can relatively move in the radial direction when locking the first to the third stator elements 4 to 6 by the locking tool 15.

Next, the second providing structure β is a structure to provide magnetic flux by contacting a magnetic body of the first magnetic body 9, which is different from the first stator element 4, with a magnetic body of the second magnetic flux 10, which is different from the second stator element 5.

The first magnetic body 9 has a flange 21 (i.e., fixed member) in an annular shape that outwardly extends from a thrust direction side of the first stator element 4. The flange 21 is also made of magnetic material.

According to the second providing structure β, magnetic flux is provided when an inner circumferential portion 23 of the non-thrust direction side yoke 16 is in surface contact with an outer circumferential portion 24 of the flange 21.

That is, the flange 21 radially extends further outside of the outer circumferential edge of the coil 2 and the outer circumferential portion 24 is positioned radially outward of the outer circumferential edge of the coil 2. A non-thrust direction side surface 23*b* of the inner circumferential portion 23 is a flat surface perpendicular to the axial direction. A thrust direction side surface 24*a* of the outer circumferential portion 24 is also a flat surface perpendicular to the axial direction.

Thus, magnetic flux is provided between the first magnetic body 9 and the second magnetic body 10 on the non-thrust direction side of the coil 2 when the thrust direction side surface 24*a* contacts on the non-thrust direction side surface 23*b*.

It should be noted that both the inner circumferential portion 23 and the outer circumferential portion 24 have no projection portion and recessed portion to fix into each other. Therefore, the inner circumferential portion 23 and the outer circumferential portion 24 can relatively move in the radial direction when locking the first to the third stator elements 4 to 6 by the locking tool 15.

Further, the first providing structure α is positioned on a thrust direction side of the second providing structure β.

The linear solenoid 1 includes a notch 25 extending through the non-thrust direction side yoke 16 and a terminal 26 of the coil 2 is extracted through the notch 25 (i.e., an extracting structure of the terminal 26). The first providing structure α is positioned on a thrust direction side of the terminal 26.

The liner solenoid 1 includes a bearing 28, an output member 29 and a bobbin 30 as described below.

The bearing 28 is fixed to the inner circumferential surface of the movable element 3 and is in direct sliding contact with the first stator element 4, while the movable element 3 is in indirect contact with the first element 4 through the bearing 28. An outer circumferential portion of the bearing 28 is made of magnetic material and an inner circumferential portion of the bearing 28 is made of non-magnetic material. Further, an inner circumferential surface of the bearing 28, which contacts directly on the outer circumferential surface of the first stator element 4 is made of non-magnetic material.

Figure 4:
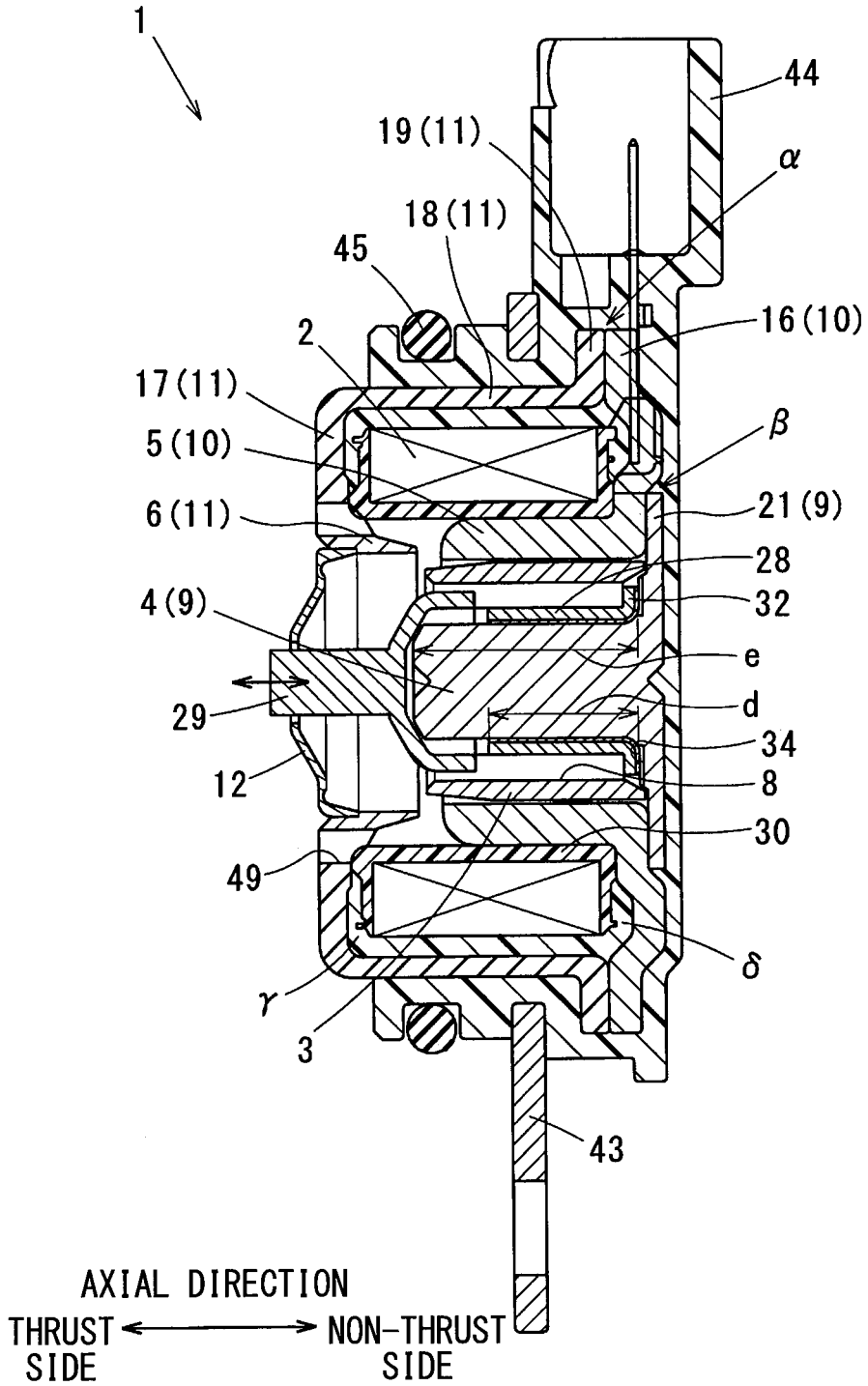
FIG. 4 is a diagram schematically illustrating a first stator element and a movable element according to the first embodiment.

In the linear solenoid 1, the inner circumferential surface of the movable element 3 has a first region that provides magnetic flux between the movable element 3 and the outer circumferential surface of the first stator element 4 in the radial direction, and a length of the first region in the axial direction is defined as a length d. Further, the outer circumferential surface of the first stator element 4 has a second region that provides magnetic flux between the first stator element 4 and the inner circumferential surface of the movable element 3 in the radial direction, and a length of the second region in the axial direction is defined as a length e. In the present embodiment, a magnitude relation between the length d and the length e is satisfied, as shown in FIG. 4. That is, the magnitude relation is that the length d is less than the length e, and the length d is substantially the same as a length of the bearing 28 in the axial direction.

The bearing 28 has a flange 32 outwardly extending from a non-thrust direction side end of the bearing 28. The movable element 3 is prevented from moving toward the non-thrust direction side in the axial direction when the flange 32 contacts on an inner circumferential portion 33 of the flange 21. A thrust direction side portion of the flange 32 is made of magnetic material, and a non-thrust direction side portion of the flange 32 is made of non-magnetic material. Further, a contact surface 32*b* of the flange 32, which is in direct contact with the inner circumferential portion 33, is made of non-magnetic material.

Figure 5A:
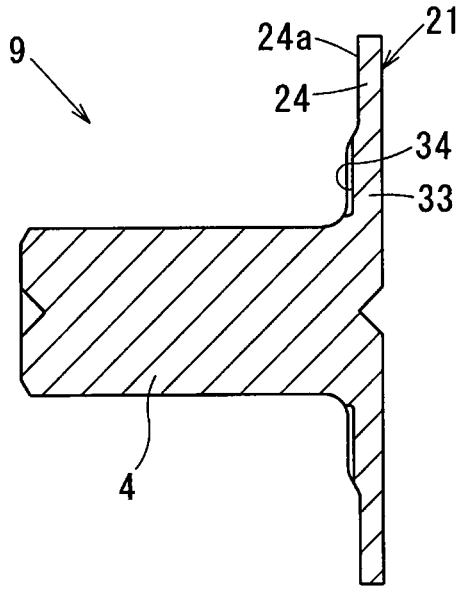
FIG. 5A is a cross-sectional view of a first magnetic body according to the first embodiment.
Figure 5B:
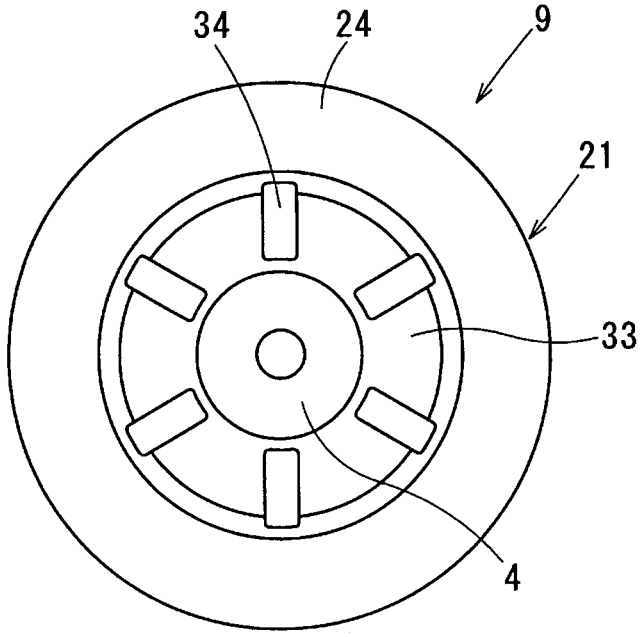
FIG. 5B is a front view of the first magnetic body according to the first embodiment.

A plurality of grooves are formed as breathing passages 34 on a thrust direction side surface of the inner circumferential portion 33 of the flange 21, and fluid flows through the breathing passages 34 in the radial direction between an inner circumferential side and an outer circumferential side of the flange 32. As shown in FIG. 5B, the breathing passages 34 radially extend and are positioned at angular intervals of 60 degrees in a circumferential direction around an axis of the linear solenoid 1.

The output member 29 is made of non-magnetic material. The output member 29 is fixed to the movable element 3 and integrally moves with the movable element 3 toward the thrust direction side of the axial direction to output the thrust force. The output member 29 receives a restoring force from outside components (not shown) and integrally moves with the movable element 3 toward the non-thrust direction side of the axial direction by the restoring force.

Further, the output member 29 has a connecting portion 36 that has a cylindrical shape and is coaxially fixed to the movable element 3, and a shaft portion 37 that has a columnar shape and protrudes toward the thrust direction side of the axial direction (i.e., a direction away from the movable element 3).

Figure 2A:
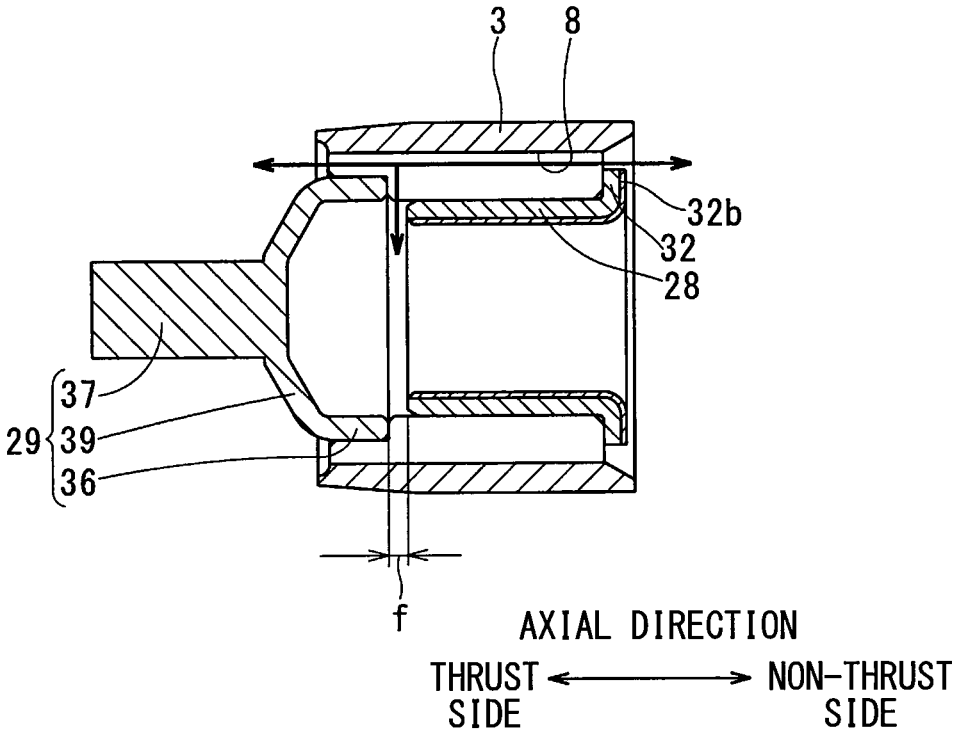
FIG. 2A is a cross-sectional view of a movable portion of the linear solenoid according to the first embodiment.
Figure 2B:
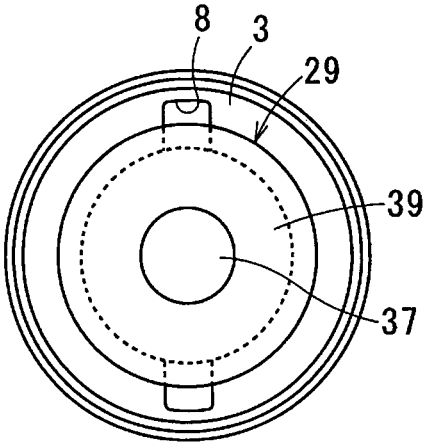
FIG. 2B is a front view of the movable portion of the linear solenoid according to the first embodiment.

As shown in FIG. 2A, the inner circumferential portion of the movable element 3 has a radially enlarged portion on a thrust direction side of the inner circumferential portion. The connecting portion 36 is press-fit into the radially enlarged portion of the movable element 3 to be fixed thereto. The bearing 28 is press-fit into a non-radially enlarged portion of the movable element 3 that is a region of the inner circumferential portion other than the radially enlarged portion. The bearing 28 is fixed to the non-radially enlarged portion of the movable element 3 at a position away from the connecting portion 36 toward the non-thrust direction side of the axial direction to form a space f between the bearing 28 and the connecting portion 36 in the axial direction (see FIG. 2A). The space f is in fluid communication with the breathing passage 8.

An opening 38 is formed at an apex of the covering portion 13 and the shaft portion 37 extends through the opening 38 of the covering portion 13. The shaft portion 37 outputs the thrust force to outside components by protruding through the opening 38 of the covering portion 13 toward the thrust direction side of the axial direction.

The shaft portion 37 has a diameter less than that of the connecting portion 36 and the shaft portion 37 and the connecting portion 38 are integrally formed by a tapered portion 39 that has a diameter decreasing toward the thrust direction side along the axial direction. One end of the first stator element 4 (i.e., a thrust direction side end of the first stator element 4) moves in the axial direction relative to the connecting portion 36 inside thereof. A circumferential edge of the thrust direction side end of the first fixing element 4 is tapered for chamfering so that an inner circumferential surface of the tapered portion 39 does not contact on the first stator element 4 even when the movable element 3 and the output member 29 moves at a limit position on the non-thrust direction side of the axial direction.

The bobbin 30 is made of resin material and the coil 2 is wound around the bobbin 30. The bobbin 30 has a cylindrical portion 40 and two flange portions 41*a* and 41*b*.

The cylindrical portion 40 is a portion that is positioned radially outside of the second and the third stator elements 5 and 6, and the coil 2 is wound around the cylindrical portion 40. The flange portion 41*a* outwardly extends from a thrust direction side end of the cylindrical portion 40, and the flange portion 41*b* outwardly extends from a non-thrust direction side end of the cylindrical portion 40. The flange portion 41*a* and 41*b* define a region therebetween for being wound by the coil 2.

The linear solenoid 1 includes a thrust direction side seal γ and a non-thrust direction side seal δ to protect the coil 2 from fluid entering into the inside of the linear solenoid 1.

Figure 6:
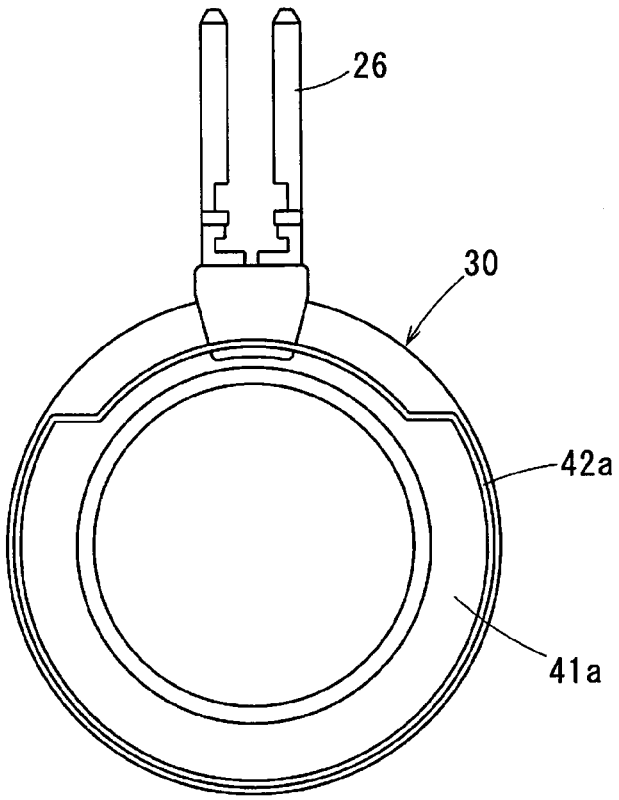
FIG. 6 is a front view of a bobbin and a terminal according to the first embodiment.

The thrust direction side seal γ is disposed on a thrust direction side of the flange 41*a* to surround the axis of the coil 2. More specifically, a resin protrusion 42*a* is formed annually on a thrust direction side surface of the flange 41*a* to surround the axis of the coil 2, as shown in FIG. 6. The thrust direction side seal γ is formed by melting the resin protrusion 42*a* with a molten resin and then curing the resin protrusion 42*a*.

The non-thrust direction side seal δ is disposed on a non-thrust direction side of the flange 41*b* to surround the axis of the coil 2. More specifically, a resin protrusion 42*b* is formed annually on a non-thrust direction side surface of the flange 41 b to surround the axis of the coil 2. The non-thrust direction side seal δ is formed by melting the resin protrusion 42*b* with the molten resin and then curing the resin protrusion 42*b*.

A manufacturing method for the linear solenoid 1 includes an injection molding step in which the molten resin is injected to the coil 2, the first to the third magnetic bodies 9 to 11, the bobbin 30, an attaching bracket 43, or the like, for molding. The thrust direction side seal γ, the non-thrust direction side seal δ and a connector 44 are formed by the molten resin that is injected during the injection molding step. Further, a groove into which an O-ring 45 is fit is also formed by the molten resin.

It should be noted that an injection opening (not shown) for injecting the molten resin is set a position during the injection molding step. As shown in FIG. 3, the set position is within a region g that faces a non-thrust direction side of the first magnetic body 9 (see FIG. 3).

The non-thrust direction side yoke 16 has a shape such that the non-thrust direction side yoke 16 does not interfere with the resin protrusion 42*b*. In other words, a middle portion 46 of the non-thrust direction side yoke 16 between the inner circumferential portion 23 and the outer circumferential portion 20 extends toward the non-thrust direction side of the axial direction. A space 47 is defined between the middle portion 46 and the flange 41*b*, as shown in FIG. 3, and the resin protrusion 42*b* protrudes into the space 47. The molten resin is filled inside the space 47.

Figure 7:
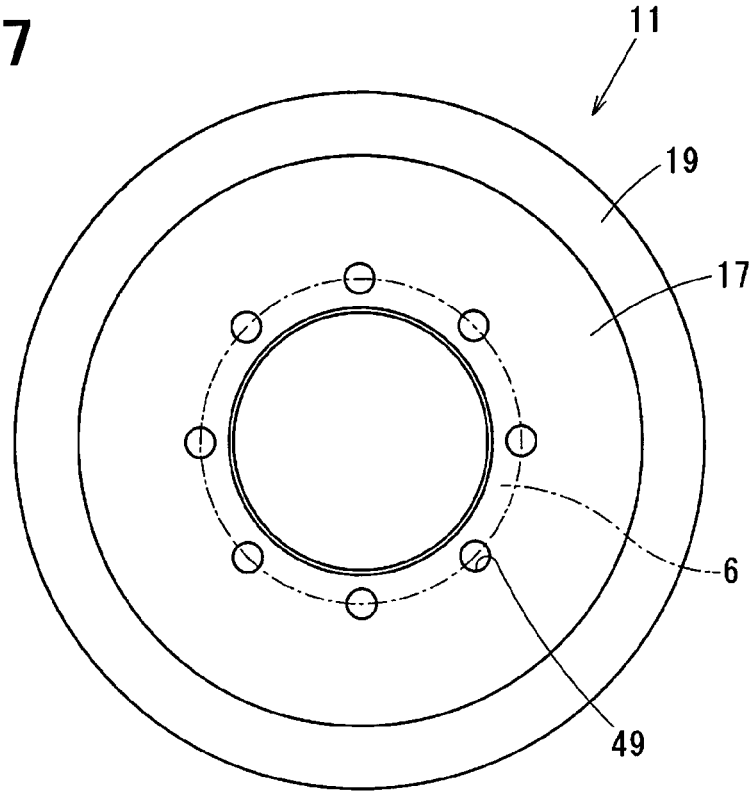
FIG. 7 is a front view of a third magnetic body according to the first embodiment.

The linear solenoid 1 has a plurality of through holes 49 extending through the third stator element 6, and the inside and the outside of the linear solenoid 1 is in fluid communication with each other through the through holes 49. The through hole 49 is open inside of the stator element 6 (i.e., the linear solenoid 1) at a position (an outward position) radially outward of the inner circumferential surface 6*a* of the third stator element 6. Each thorough hole 49 extends in a direction substantially parallel to the axis of the linear solenoid. Further, the through holes 49 are formed around the axis of the coil 2 at angular intervals of 45degrees, for example, (see FIG. 7).

Figure 8:
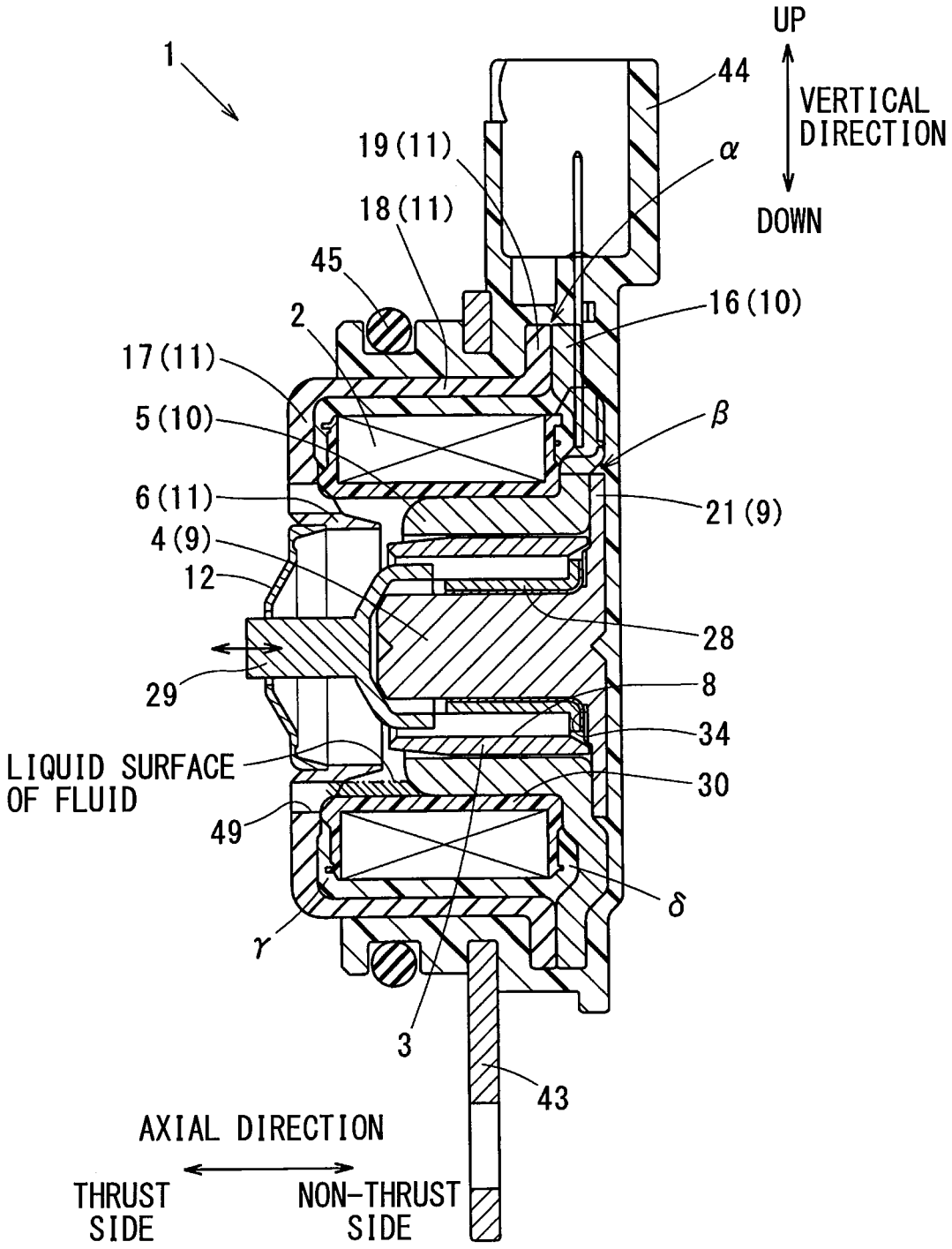
FIG. 8 is a cross-sectional view of the linear solenoid indicating a liquid surface according to the first embodiment.

The axial direction of the linear solenoid 1 is substantially aligned with a horizontal direction and the linear solenoid 1 is installed to a vehicle such that a center between the through holes 49 adjacent to each other is at a lowest position. In this case, the connector 44 protrudes upwardly in a vertical direction and the attaching bracket 43 protrudes downwardly in the vertical direction, as shown in FIG. 8. Accordingly, a liquid surface of fluid inside the linear solenoid 1 is positioned lower than the inner circumferential surface 6*a* of the third stator element 6 (see FIG. 8).

According to the above-described configurations, magnetic flux is provided between the first and the second stator elements 4 and 5 and the movable element 3 in the radial direction, and magnetic flux is provided between the movable element 3 and the third stator element 6 in the radial direction. Thus, the movable element 3 is attracted and moves toward the thrust direction side of the axial direction, whereby the linear solenoid 1 outputs a thrust force in the axial direction.

(Effects of the First Embodiment)

According to the first embodiment 1, the movable element 3 has the cylindrical magnetic portion, and the first and the second stator elements 4 and 5 are respectively disposed inside and outside of the movable element 3. Magnetic flux is provided from both the first and the second stator elements 4 and 5 to the movable element 3 in the radial direction. Further, the third stator element 6 is the cylindrical magnetic body that is disposed away from the second stator element 5 toward the thrust direction side of the axial direction. The third stator element 6 attracts the movable element 3 toward the thrust direction side of the axial direction and draws the movable element 3 into the inside of the third stator element 6. The opening 6*b* formed on the thrust direction side of the third stator element 6 is covered by the cover 12. Furthermore, the third stator element 6 is formed with the through holes 49 that extend through the third stator element 6. The inside and the outside of the third stator element 6 (i.e., the linear solenoid 1) are in fluid communication with each other through the through holes 49.

Thus, fluid can be introduced into and discharged from the linear solenoid 1 through the through holes 49. As a result, fluid can be smoothly introduced into and discharged from the linear solenoid 1, whereby improving responsiveness of the movable element 3.

The through hole 49 is open the inside of the linear solenoid 1 (more specifically the third stator element 6) at the outward position radially outward of the inner circumferential surface 6*a* of the third stator element 6.

Therefore, the liquid surface of fluid inside the linear solenoid 1 can be positioned lower than the inner circumferential surface 6*a* of the third stator element 6 when the axis of the linear solenoid 1 is substantially aligned with the horizontal direction. Thus, the attraction force of the third stator element 6 can be prohibited from fluctuating by magnetic foreign substances inside the fluid.

Further, the linear solenoid has a plurality of the through holes 49 around the axis of the coil 2.

Therefore, a degree of freedom to select a direction from the axis of the linear solenoid 1 to the through hole 49, which is in the vertical direction, among a variety of directions from the axis toward the outer circumference can be increased.

Further, the magnitude relation of the length d<the length e is satisfied between the length d of the first region in the axial direction and the length e of the second region in the axial direction.

Therefore, even when the stroke of the movable element 3 is increased, a decrease in the area that contributes to the provision of the magnetic flux between the movable element 3 and the first stator element 4 can be suppressed. As a result, deterioration of the attraction force can be suppressed even when the stroke of the movable element 3 is increased.

Further, the bearing 28 is fixed to the inner circumferential surface of the movable element 3, and the bearing 28 has the inner circumferential surface that is made of non-magnetic material and is in sliding contact with the first stator element 4.

Thus, it is possible to prevent the movable element 3 from adhering to the first stator element 4, i.e., avoid a state in which the movable element 3 is not capable of sliding relative to the first stator element 4.

The movable element 3 is provided with the output member 29 made of non-magnetic material that integrally moves with the movable element 3 and outputs thrust force. The output member 29 has the connecting portion 36 that has the cylindrical shape and is coaxially fixed to the movable element 3 and the shaft portion 37 that has the columnar shape and protrudes toward the thrust direction side of the axial direction. The thrust direction side end of the first stator element 4 moves in the axial direction relative to the connecting portion 36 inside thereof, and the shaft portion 37 has the diameter less than that of the connecting portion 36.

Therefore, the output member 29 can prevented from contacting the first stator element 4 whereby preventing an increase in sliding resistance. Further, design freedom for components that receive the thrust force from the shaft portion 37 can be improved by reducing the size of the shaft portion in the radial direction.

The breathing passage 8 is formed in the movable element 3 in the axial direction and fluid is introduced into and discharged from the coil 2 through the breathing passage 8.

Therefore, fluid can be smoothly introduced into and discharged from the movable element 3 between the thrust direction side end and the non-thrust direction side end thereof, and thus the movable element 3 can smoothly move in the axial direction.

The bearing 28 is fixed to the movable element 3 at a position away from the connecting portion 36 toward the non-thrust direction side of the axial direction, and the space f is formed between the bearing 28 and the connecting portion 36. The space f is in fluid communication with the breathing passage 8.

Hence, fluid can smoothly flow through between the inner circumferential surface of the connecting portion 36 and the breathing passage 8, whereby the movable element 3 and the output member 29 can integrally and move in the axial direction in a smooth manner.

The bearing 28 has the first flange 32 that radially protrudes outward of the bearing 28 and the movement of the movable element 3 toward the non-thrust direction side of the axial direction is prevented when the first flange 32 contacts on the flange 21.

Therefore, the movable element 3 can be prevented from moving while alleviating contact of the movable element 3 on the flange 21.

The flange 21, on which the first flange 32 contacts, is one of portions of the first magnetic body 9. Thus, by making the contact surface 32*b* of the flange 32, which is in direct contact with the flange 21, with non-magnetic material, it is possible to prevent the bearing 28 from adhering to the flange 21, i.e., to avoid such a situation that the movable element 3 is not incapable of moving.

Furthermore, the flange 21 has the breathing passage 34 that provides fluid communication in the radial direction between the inner circumferential side and the outer circumferential side of the first flange 32.

Thus, the fluid can be smoothly introduced into and discharged from the first flange 32 whereby the movable element 3 can smoothly move in the axial direction.

(Second Embodiment)

Figure 9:
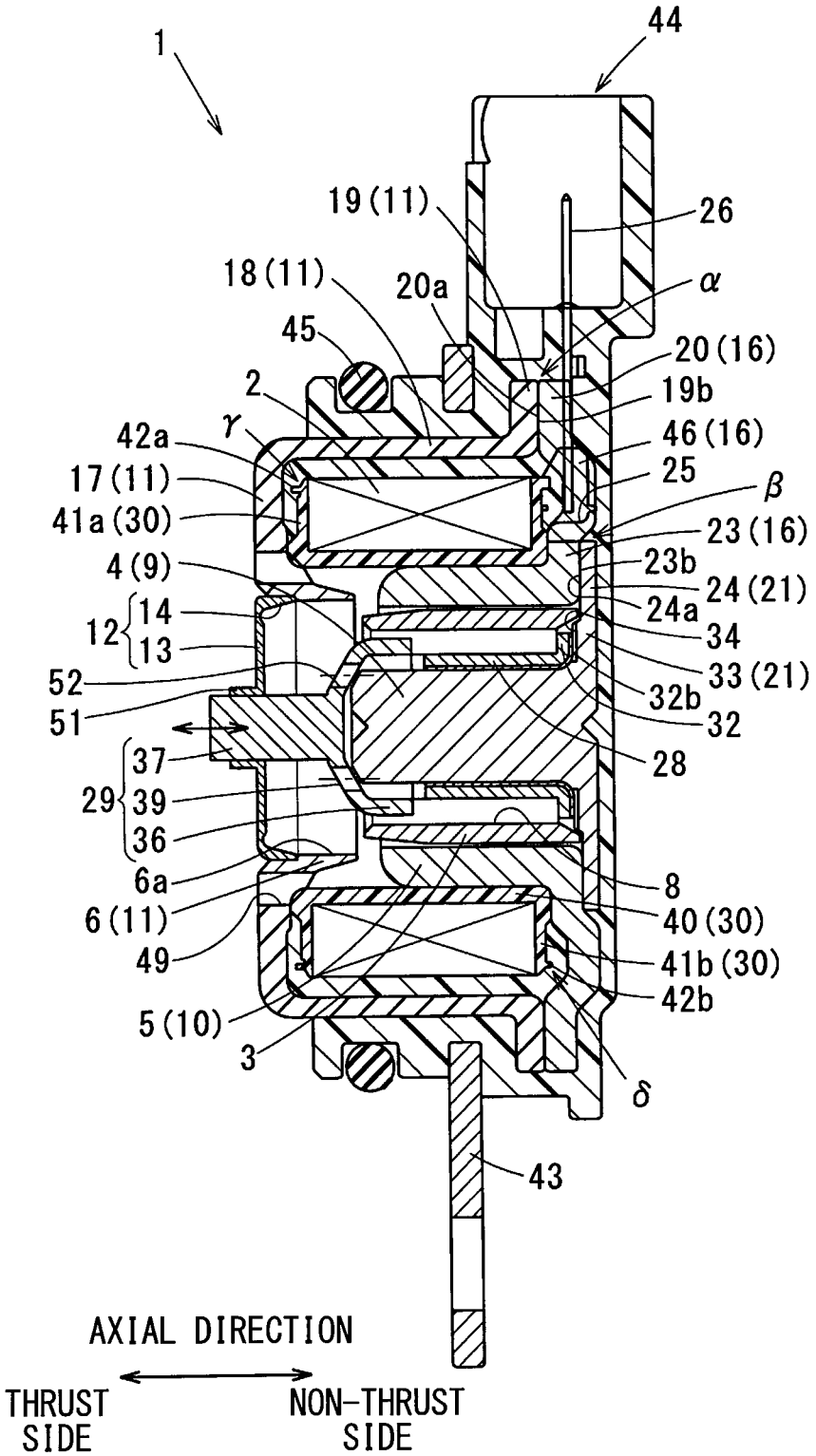
FIG. 9 is a cross-sectional view of a linear solenoid according to a second embodiment.

In a linear solenoid 1 of the second embodiment, a covering portion 13 of a cover 12 has a plate shape that is perpendicular to an axial direction of the linear solenoid 1, as shown in FIG. 9. That is, the covering portion 13 does not extend toward the thrust direction side of the axial direction. A center of the covering portion 13 has a bearing portion 51 that slidably supports a shaft portion 37 in the axial direction. The bearing portion 51 has a cylindrical shape and protrudes toward the thrust direction side of the axial direction. An outer circumferential surface of the shaft portion 37 is in sliding contact with an inner circumferential surface of the bearing portion 51.

Accordingly, a movable member configured by the movable element 3 and an output member 29 can be supported at both end sides. Thus, a load imposed by the movable member (i.e., the movable element 3 and the output member 29) is supported by a center impeller-type bearing structure (i.e., the bearing portions 28 and 51), and thus the movable member can stably move in the axial direction.

A tapered portion 39 of the output portion 29 has a hole portion 52 passing through the tapered portion 39 in the axial direction, and an inside of the connecting portion 36 is in fluid communication with the an outside of the connecting portion 36 through the hole portion 52.

Accordingly, fluid can be introduced into and discharged from the connecting portion 36, and thus the movable member (i.e., the movable element 3 and the output member 29) can further smoothly move in the axial direction.

(Modification)

A configuration of the linear solenoid 1 is not necessarily limited to that of the above-described embodiments, and a variety of modifications may be applied.

In regard to the movable element 3, the first to the third stator elements 4 to 6, the first to the third magnetic bodies 9 to 11, the first and the second providing structures α and β, the through hole 49, the bearing 28, the breathing passages 8 and 34, the output member 29, the thrust direction side and the non-thrust direction side seals γ and δ, the extracting structure of the terminal 26, the magnitude relation between the length d and the length e in the axial direction, the magnitude relation between the inner radiuses a and b, and the sliding and supporting structure of the integral member (the movable member) of the movable element 3 and the output member 29, a variety of modifications can be applied.

For example, according to the linear solenoid 1 of the first embodiment, the cantilever-type bearing structure, in which the movable element 3 is slidably supported by the first stator element 4 from the inside the movable element 3, is used. Whereas, according to the linear solenoid 1 of the second embodiment, the center impeller-type bearing structure, in which the movable element 3 is slidably supported by the first stator element 4 and the shaft portion 37 is slidably supported by the covering portion 13, is used. However, another cantilever-type bearing structure, in which the movable element 3 is slidably supported by the second stator element 5 from an outside of the movable element 3 or the output member 29 is slidably supported, may be used. Alternatively, a bearing structure in which the shaft portion 37 is only supported may be used. Further, another center impeller-type bearing structure, in which the movable element 3 is slidably supported by the second stator element 5 and the shaft portion 37 is slidably supported, may be used.

According to the linear solenoid 1 of the embodiments, the breathing passage 34 is formed on the flange 21 (i.e., fixed member) of the first magnetic body 9. However, the breathing passage 34 may be formed on the flange 32 of the bearing 28 or in both the flange 21 and the flange 32.

What is claimed is:

1. A linear solenoid outputting a thrust force in an axial direction toward a thrust direction side of the axial direction when magnetic flux is generated by energizing a coil, the linear solenoid comprising:

a movable element having a cylindrical magnetic portion, the movable element being coaxially disposed inside of the coil and movable in the axial direction;

a first stator element disposed inside of the cylindrical magnetic portion of the movable element and providing magnetic flux to the movable element in a radial direction, the first stator element being made of magnetic material;

a second stator element having a cylindrical shape and made of magnetic material, the second stator element (i) being disposed outside of the movable element in the radial direction that is interposed between the first stator element and the second stator element, and (ii) providing magnetic flux to the movable element in the radial direction;

a third stator element having a cylindrical shape and made of magnetic material, the third stator element (i) being disposed on a thrust direction side of the second stator element, (ii) magnetically attracting the movable element toward the thrust direction side of the axial direction to draw the movable element into an inside of the third stator element, and (iii) having an opening formed on a thrust direction side of the third stator element;

a cover covering the opening of the third stator element; and a through hole extends through the third stator element, wherein the through hole provides fluid communication between the inside of the third stator element and an outside of the third stator element.

2. The linear solenoid according to claim 1, wherein the through hole is open inside the third stator element at a position radially outward of an inner circumferential surface of the third stator element.

3. The linear solenoid according to claim 1, wherein a plurality of through holes positioned around an axis of the coil.

4. The linear solenoid according to claim 1, further comprising an output member fixed to a thrust direction side of the movable element and moving integrally with the movable element toward the thrust direction side of the axial direction to output the thrust force, the output member being formed of non-magnetic material, wherein the output member has a shaft portion that protrudes toward the thrust direction side of the axial direction and passes through the cover to transmit the thrust force to the outside of the third stator element, the cover has a bearing portion that slidably supports the shaft portion in the axial direction, and the movable element is slidably supported in the axial direction by the first stator element or the second stator element.

5. The linear solenoid according to claim 1, further comprising an output member fixed to a thrust direction side of the movable element and moving integrally with the movable element toward the thrust direction side of the axial direction to output the thrust force, the output member being formed of non-magnetic material, wherein the output member has (i) a connecting portion having a cylindrical shape and coaxially fixed to the movable element, (ii) a shaft portion that passes through the cover to protrude toward the thrust direction side of the axial direction and that transmits the thrust force to the outside of the third stator element, and (iii) a hole portion through which an inside of the connecting portion fluidly communicates with an outside of the connecting portion, and a thrust direction side end of the first stator element moves inside the connecting portion in the axial direction relative to the connecting portion.

6. A linear solenoid outputting a thrust force in an axial direction toward a thrust direction side of the axial direction when magnetic flux is generated by energizing a coil, the linear solenoid comprising:

a movable element having a cylindrical magnetic portion, the movable element being coaxially disposed inside of the coil and movable in the axial direction;

a first stator element disposed inside of the cylindrical magnetic portion of the movable element and providing magnetic flux to the movable body in a radial direction, the first stator element being made of magnetic material;

a second stator element having a cylindrical shape and made of magnetic material, the second stator element (i) being disposed outside of the movable element in the radial direction that is interposed between the first stator element and the second stator element, and (ii) providing magnetic flux to the movable element in the radial direction; and a third stator element having a cylindrical shape and made of magnetic material, the third stator element (i) being disposed on a thrust direction side of the second stator element, and (ii) magnetically attracting the movable element to draw the movable element into an inside of the third stator element, wherein the movable element has a first region on an inner circumferential surface of the movable element that provides magnetic flux between the movable element and the first stator element in the radial direction, the first stator element has a second region on an outer circumferential surface of the first stator element that provides magnetic flux between the first stator element and the movable element in the radial direction, a length of the first region in the axial direction is less than a length of the second region in the axial direction, the linear solenoid further comprises an output member fixed to a thrust direction side of the movable element and moving integrally with the movable element toward the thrust direction side of the axial direction to output the thrust force, the output member being formed of non-magnetic material, the output member has (i) a connecting portion having a cylindrical shape and coaxially fixed to the movable element, and (ii) a shaft portion protruding away from the movable element toward the thrust direction side of the axial direction, one end of the first stator element slides inside the connecting portion in the axial direction relative to the connecting portion, and the shaft portion has a radius less than that of the connecting portion.

7. The linear solenoid according to claim 6, further comprising a bearing fixed to the inner circumferential surface of the movable element and being in sliding contact with the first stator element, wherein an inner circumferential surface of the bearing is in direct sliding contact with the outer circumferential surface of the first stator element, and the inner circumferential surface of the bearing is made of non-magnetic material.

8. The linear solenoid according to claim 6, wherein the movable element has a breathing passage that passes through the movable element between both ends of the movable element in the axial direction, and fluid is introduced into and discharged from the movable element through the breathing passage.

9. The linear solenoid according to claim 8, further comprising:

a bearing fixed to the inner circumferential surface of the movable element and being in sliding contact with the first stator element; wherein the bearing is positioned away from the connecting portion to form a space in the axial direction, and the space is in fluid communication with the breathing passage.

10. The linear solenoid according to claim 6, further comprising a bearing fixed to the inner circumferential surface of the movable element and being in sliding contact with the first stator element, wherein the bearing has a flange outwardly extending in the radial direction, and the movable element is prevented from moving when the flange contacts on a fixed member.

11. The linear solenoid according to claim 10, wherein the fixed member is made of magnetic material and integrally formed with the first stator element, and the flange has a contact surface that is made of non-magnetic material and contacts the fixed member.

12. The linear solenoid according to claim 11, further comprising a breathing passage formed in at least one of the flange or the fixed member, wherein fluid flows through the breathing passage in the radial direction between an inner circumferential side and an outer circumferential side of the flange.

* * * * *